US006669610B2

(12) United States Patent
Slowinski

(10) Patent No.: US 6,669,610 B2
(45) Date of Patent: Dec. 30, 2003

(54) METHOD AND APPARATUS FOR EXERCISING INTERNAL AND EXTERNAL OBLIQUE MUSCLES

(76) Inventor: Peter Slowinski, 26411 N. 114th Pl., Scottsdale, AZ (US) 85255

( * ) Notice: Subject to any disclaimer, the term of this patent is extended or adjusted under 35 U.S.C. 154(b) by 0 days.

(21) Appl. No.: 10/035,995

(22) Filed: Dec. 31, 2001

(65) Prior Publication Data

US 2003/0125172 A1 Jul. 3, 2003

(51) Int. Cl.[7] ..... A63B 22/16

(52) U.S. Cl. ..... 482/146

(58) Field of Search ..... 482/145, 146, 482/147, 79, 80, 148

(56) References Cited

U.S. PATENT DOCUMENTS

| | | | | |
|---|---|---|---|---|
| 4,305,579 A | * | 12/1981 | Rice | 272/146 |
| 4,538,807 A | * | 9/1985 | Rice | 272/146 |
| 5,368,535 A | * | 11/1994 | Twardokens | 482/79 |
| 5,433,690 A | * | 7/1995 | Gilman | 482/146 |
| 5,890,999 A | | 4/1999 | Kildani | |
| 6,244,994 B1 | | 6/2001 | Tilberis | |

* cited by examiner

*Primary Examiner*—Nicholas D. Lucchesi
*Assistant Examiner*—L Amerson
(74) *Attorney, Agent, or Firm*—Tod R. Nissle, P.C.

(57) ABSTRACT

A method and apparatus for exercising internal and external oblique muscles utilizes lateral forces generated by the feet and maintain the upper body in a fixed position to facilitate exercise of the oblique muscles. The apparatus and method vary the inertial forces applied outside the feet to affect the degree of difficulty of the exercise.

1 Claim, 2 Drawing Sheets

METHOD AND APPARATUS FOR EXERCISING INTERNAL AND EXTERNAL OBLIQUE MUSCLES

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable.

BACKGROUND OF THE INVENTION (1) Field of the Invention

This invention pertains to a method and apparatus for exercising the internal and external oblique muscles of the human body.

More particularly, this invention pertains to a method and apparatus for exercising the oblique muscles while minimizing the risk of injury during the exercise.

In another respect, the invention pertains to an exercise method and apparatus which utilizes lateral forces generated by the feet to facilitate exercise of the oblique muscles.

In a further respect, the invention pertains to an exercise method and apparatus which utilizes arm and upper body muscles to maintain the upper body in a relatively stationary position to facilitate exercise of the oblique muscles.

In still another respect, the invention pertains to an exercise apparatus and method which varies the inertial forces applied outside the feet to affect the degree of difficulty of the exercise.

(2) Description of Related Art Including Information Disclosed Under 37 CFR 1.97 and 1.98.

Many kinds of exercise apparatus exist.

For example, U.S. Pat. No. 6,224,994 claims a method of exercising the upper body:

1. A method of exercising the upper body by tension and torsion comprising the steps of:
   - placing an inelastic strap having opposed ends and a handle at each end around the upper back, shoulders and upper arms of a user's body having an axis,
   - gripping each handle at the ends of the strap;
   - tensioning the upper body muscles to any extend desired while gripping the handles and applying pressure on the upper body, shoulders and upper arms;
   - twisting the upper body about the axis of the user's body; and
   - maintaining the handles substantially parallel to the axis of the user's body and the same distance therefrom during the twisting of the upper body.

U.S. Pat. No. 5,890,999 claims a method of exercising an individual's hands:

23. A method of exercising an individual's hands, comprising the steps of:
   - (1) providing a hand held exerciser having
     - (a) a ball body including an elastomeric shell and a filler material within said elastomeric shell,
     - (b) said elastomeric shell being made from a resilient and stretchable elastomeric material, said elastomeric shell having a interior cavity defined within said shell,
     - (c) said filler material filling the entire cavity within said shell, said filler material comprising a putty which substantially maintains its shape without flowing, but which freely moves when compressed;
   - (2) placing the hand held exercise within the palm of an individual's hand; and,
   - (3) having the individual repeatedly compress the hand exerciser within his hand with sufficient force to exercise the muscles with in the individual's wrist.

A variety of other exercises and exercise apparatus exist for exercising the various muscles in the body. The waist is, however, one area which is difficult for many individuals to exercise to tone muscles and reduce fat. It is believed that this problem is in part due to the fact that many individuals focus on doing "crunches" and other types of sit-ups which exercise the abdominal muscles. While exercises for the rectus abdominis are important, such exercises do not focus on the exterior and interior oblique muscles. The oblique muscles extend diagonally around an individual's sides and are important in firming up an individual's waist line. The old dance the "twist" performed by Chubby Checker utilizes the oblique muscles in order to twist the waist during the dance. The "twist" typically does not, however, apply excessive stress to the oblique muscles because the movement of a person's upper body in a direction opposite that of the person's hips makes the twisting movement fairly easy. On the other hand, twisting exercises can pose an injury risk with respect to an individual's lower back.

A variety of exercise equipment also exists which permits an individual to stand on a round flat horizontally-oriented rotatable plate and to turn the individual's feet from side to side to rotate the plate. The movement of the hips on such apparatus is similar to the movement of the hips during the "twist" dance.

Accordingly, it would be highly desirable to provide an improved method and apparatus for exercising the oblique muscles.

It would also be highly desirable to provide an improved oblique muscle exercise method and apparatus which would effectively exercise the oblique muscles while minimizing the risk of injury to the lower back and spine of an individual.

Therefore, it is the principal object of the invention to provide improved exercise apparatus.

Another object of the invention is to provide an improved method and apparatus for exercising the internal and external oblique muscles while minimizing the risk of a back injury.

A further object of the invention is to provide an improved method and apparatus for exercising the oblique muscles while simultaneously providing an aerobic workout for the body.

BRIEF DESCRIPTION OF THE SEVERAL VIEWS OF THE DRAWING(S)

These and other, further and more specific objects and advantages of the invention will be apparent to those skilled in the art from the following detailed description thereof, taken in conjunction with the drawings, in which.

BRIEF SUMMARY OF THE INVENTION

Figure 1:
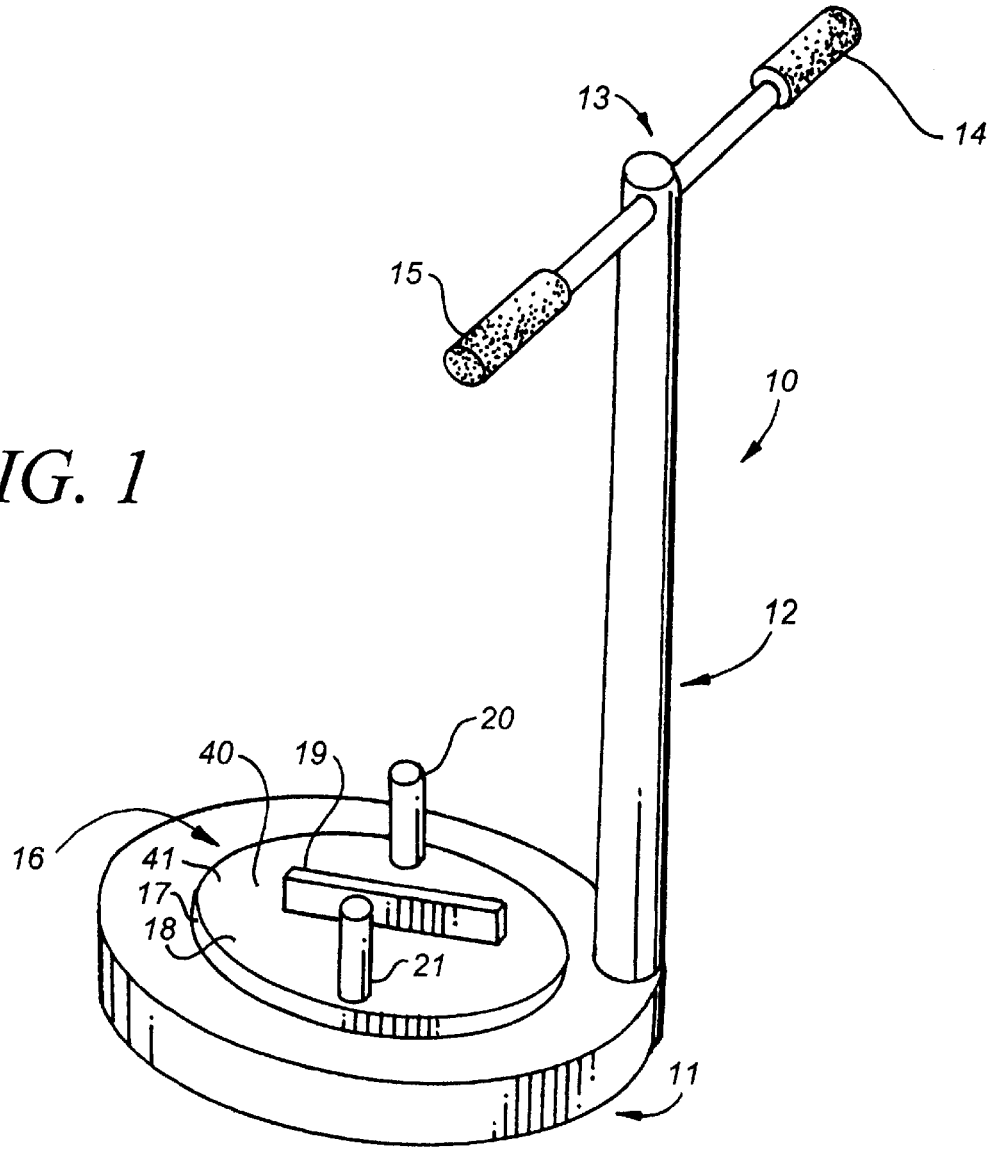
FIG. 1 is a perspective view illustrating apparatus constructed in accordance with the principles of the invention.

Briefly, in accordance with the invention, an improved exercise apparatus is provided. The apparatus exercises the internal and external oblique muscles by maintaining the arms in fixed position and by rotating the lower body to overcome inertial forces which counteract rotation of the feet and lower body. The apparatus includes a base; a neck extending above and fixedly attached to the base, the neck including a distal end; a first handle fixedly attached to the distal end of the neck to receive the right hand of an individual using the exercise apparatus; a second handle fixedly attached to the distal end of the neck to receive the left hand of an individual using the exercise apparatus; a platform rotatably mounted on the base and including a central area and a peripheral area; a divider fixedly attached to and extending upwardly from the central area of the platform, the platform receiving the feet of an individual, each foot on an opposing side of and pressed against the divider; and, weights mounted on the peripheral area of the platform and spaced apart from the divider. The weights provide inertia opposing rotation of the platform; and, generate resistance when oblique muscles rotate the feet, hips, and legs of an individual standing on the platform.

In another embodiment of the invention, an improved exercise method is provided to activate the oblique muscles. The improved method comprises the step of providing apparatus including a base; a neck extending above and fixedly attached to the base, the neck including a distal end; a first handle fixedly attached to the distal end of the neck to receive the right hand of an individual using the exercise apparatus; a second handle fixedly attached to the distal end of the neck to receive the left hand of an individual using the exercise apparatus; a platform rotatably mounted on the base and including a central area and a peripheral area; a divider fixedly attached to and extending upwardly from the central area of the platform, the platform receiving the feet of an individual, each foot on an opposing side of and pressed against the divider; and, weights mounted on the peripheral area of the platform and spaced apart from the divider. The weights provide inertia opposing rotation of said platform; and, generate resistance when oblique muscles rotate the feet, hips, and legs of an individual standing on the platform. The improved method also includes the steps of having the individual stand on the platform with each foot on an opposite side of and contacting the divider; having the individual grasp the first handle with the individual's right hand; having the individual grasp the second handle with the individual's left hand; having the individual, while grasping said handles, maintain his arms in fixed position; having the individual slightly bend his knees from the position where the individual's knees would be locked and straight, and maintain the individual's knees in the resulting slightly bent position; having the individual turn his legs and hips to the left by simultaneously pressing his right foot against said divider and rotating his hips and said platform to the left; having the individual turn his legs and hips to the right by simultaneously pressing his left foot against the divider and rotating his hips and said platform to the right; and, repeating steps (g) and (h) at a desired number of repetitions per minute for a selected period of time.

DETAILED DESCRIPTION OF THE INVENTION

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates exercise apparatus constructed in accordance with the principles of the invention and generally indicated by reference character 10. Apparatus 10 includes base 11, neck 12, and handle assembly 13 connected to the distal end of neck 12. The proximate end of neck 12 is connected to base 11. Neck 12 is preferably, although not necessarily, fixedly connected to base 11 such that neck 12 is always stationary. Similarly, handle assembly 13 is preferably, although not necessarily, fixedly connected to the distal end of neck 12 such that assembly 13 is always stationary. Assembly 13 includes left handle 14 and right handle 15. The height of assembly 13 above base 11 can, if desired, be adjustable.

Figure 2:
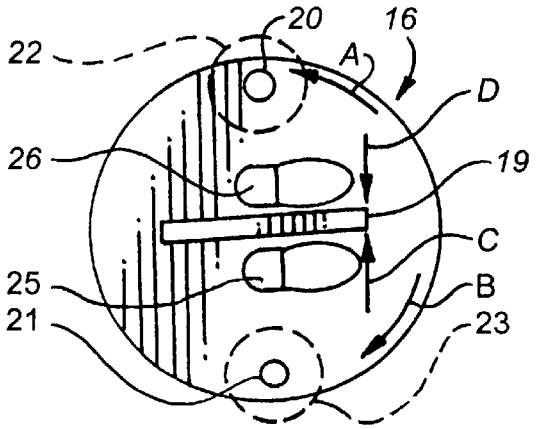
FIG. 2 is a top view of the rotating plate of the apparatus of FIG. 1 illustrating the mode of operation thereof; and, FIG. 3 is a perspective view of portions of the apparatus of FIG. 1 further illustrating the mode of operation thereof.

Circular platform 16 is rotatably mounted on base 11 to turn in the directions indicated by arrows A and B in FIG. 2. The shape and dimension of platform 16 can vary as desired. Platform 16 includes peripheral edge 17 and upper surface 18. Platform 16 includes a peripheral area adjacent edge 17.

Upwardly projecting pegs 20 and 21 are mounted in the peripheral area 41 of platform 16. Pegs 20 and 21 function both as weights and as a means for receiving additional weights. Cylindrical doughnut shaped weights 22, 23 are slid over pegs 20 and 21. Pegs 20 and 21 preferably are long enough to permit two or more weights to be stacked on each peg 20 and 21. Other means can be provided in place of pegs 20 and 21 to secure weight on the periphery of platform 16. The shape and dimension of the weights 22, 23 can vary as desired. Weight(s) can be positioned at any location(s) on platform 16.

Upstanding divider 19 is fixedly connected to platform 16 in the central area 40 of platform 16.

Figure 3:
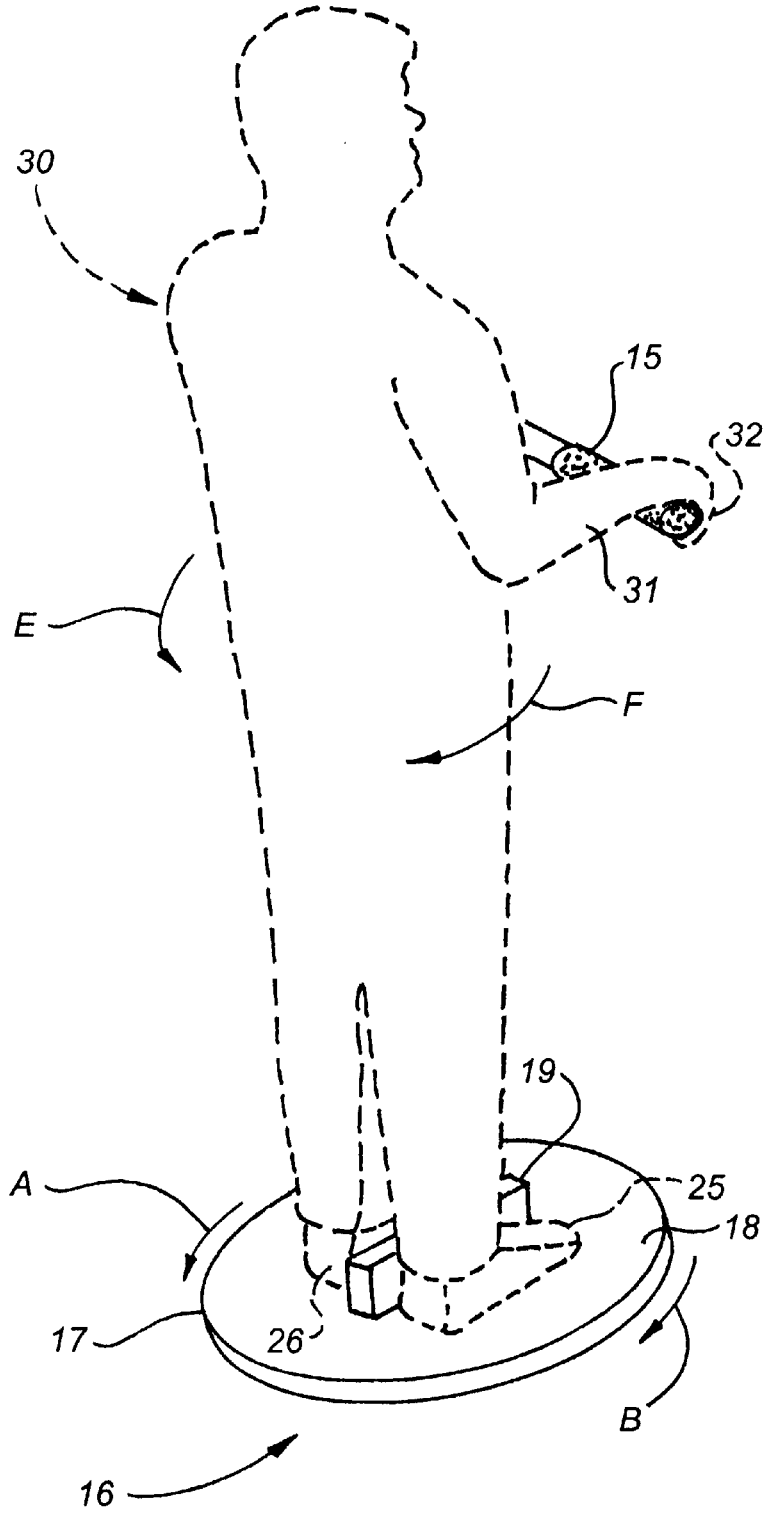

In use, an individual 30 stands on platform 16 with his left foot 26 and right foot 25 in the positions shown in FIGS. 2 and 3. The inside of each foot 25, 26 contacts or is adjacent divider 19. The individual grasps handle 15 with his right hand 32 and grasps handle 14 with his left hand (not visible). The hands normally are at least shoulder width apart, preferably wider than shoulder width so the hands are "outside" the shoulders. The hands can, if desired, be closer together than shoulder width. The right arm 31 and left arm (not visible) are preferably, but not necessarily, bent in the manner illustrated in FIG. 3. The individual's knees are slightly bent and are not locked straight. This is important in preventing injuries to the knees and in providing flexible movement of the legs to minimize the likelihood of injury to the individual's back. While the knees are maintained in a slightly bent position when the individual twists his waist in the manner described below, the knees move and rotate as the feet rotate with platform 16. Attempting to maintain the knees in a fixed position when the feet and hips rotate would likely injure the knees. Accordingly, the knees, although slightly bent, turn simultaneously in the same general direction that the feet and hips are moving.

The individual pulls in his stomach, also to protect his back, and uses his oblique muscles to turn his hips to the right in the direction of arrow F to the right. When the individual turns his hips to the right in the direction of arrow F, feet 25, 26 and platform 16 rotate on base 11 in the direction of arrow B. While the hips are turning to the right in the direction of arrow F, the individual's left foot 26 presses against divider 19 in the direction of arrow D to stabilize the feet in position on platform 16. When the individual's hips are turning in the direction of arrow F, it is important for the individual to focus on keeping his arms stationary. This forces the oblique muscles to work harder to turn the individual's hips in the direction of arrow F. It is also important for the individual to realize that his torso will, to a limited extend, turn with his hips. The individual's shoulders will move slightly. Attempting to totally immobilize the torso is not recommended because it is believed important that the individual's spine be able to turn or move naturally and freely along its entire length extending from the neck down to the individual's trunk. Attempts to immobilize the torso during utilization of the apparatus of the invention are not recommended and are to be avoided.

After the individual has turned his hips a comfortable distance in the direction of arrow F, he utilizes his internal and external oblique muscles to reverse direction and turn his hips to the left in the direction of arrow E in FIG. 3. The individual continues to hold his abdominal muscles in to protect his back. When the individual turns his hips to the left in the direction of arrow E, feet 25, 26 and platform 16 rotate on base 11 in the direction of arrow A. While the hips are turning in the direction of arrow E, the individual's right foot 25 presses against divider 19 in the direction of arrow C (FIG. 2) to stabilize the feet in position on platform 16. When the individual's hips are turning in the direction of arrow F, it is important for the individual to focus on keeping his arms 31 stationary. This forces the oblique muscles to work harder to turn the individual's hips in the direction of arrow F. It is also important for the individual to realize that his torso will, to a limited extend, turn with his hips The individual's shoulders will move slightly. Attempting to totally immobilize the torso is not recommended because it is believed important that the individual's spine be able to turn or move naturally and freely along its entire length extending from the neck down to the individual's trunk. Attempts to immobilize the torso during utilization of the apparatus of the invention are not recommended and are to be avoided. Apart from safety concerns, one reason the torso should not be immobilized is that it interferes with the full range of motion of the oblique muscles.

To increase the difficulty required to rotate the hips and platform 16, weights 22, 23 can be stacked on pegs 20 and 21. Weights 22, 23 provide inertial forces which must be overcome to rotate platform 16. The use of weights 22, 23 facilitates the burning of fat. Pegs 20 and 21 (and weights 22, 23) preferably are positioned to the sides of feet 25, 26 in the manner illustrated in FIG. 2. Pegs 20 and 21 can be positioned at any location on platform 16, but appear most effective when placed next to and laterally from the sides of feet 25, 26. Attempting to turn a foot with a weight on the ankle at the side of the foot is different than turning the same foot with the weight on the toes at the front of the foot.

The internal and external oblique muscles function to provide lateral flexion of the spine and to rotate the spine. The other function of the oblique muscles is to hold tightly and contain the organs and other contents at the mid-section of the body.

When the individual turns his hips to the right in the direction of arrow F, the inside of the left foot pushes against divider 19 in the direction of arrow D, the left external oblique resists or opposes the turn, and the right internal oblique helps to make the turn.

When the individual turns his hips to the left in the direction of arrow E, the inside of the right foot pushes against divider 19 in the direction of arrow C, the right external oblique resists or opposes the turn, and the left internal oblique helps to make the turn.

Pushing against divider 19 with feet 25, 26 is important because it helps to isolate and exercise oblique muscles when the apparatus of FIG. 1 is used.

One advantage of the apparatus of the invention is that it puts into play many muscles in the body and is readily utilized to provide an elevated heart rate and produce aerobic exercise. The arm and shoulder muscles are utilized to maintain the arm in fixed position. Bending the knees involves the leg muscles, which are some of the largest muscles in the body.

Having described my invention in such terms as to enable those of skill in the art to make and practice it, and having described the presently preferred embodiments thereof, I claim:

1. An exercise method to activate the oblique muscles, comprising (a) providing exercise apparatus including
  (i) a base;
  (ii) a neck extending above and fixedly attached to said base, said neck including a distal end;
  (iii) a first handle fixedly attached to said distal end of said neck to receive the right hand of an individual using the exercise apparatus;
  (iv) a second handle fixedly attached to said distal end of said neck to receive the left hand of an individual using said exercise apparatus;
  (v) a platform rotatably mounted on said base and including a central area and a peripheral area;
  (vi) a divider fixedly attached to and extending upwardly from said central area of said base, said platform receiving the feet of an individual, each of the feet being on an opposing side of and pressed against said divider; and,
  (vii) weight means mounted on said peripheral area of said platform and spaced apart from said divider to provide inertia opposing rotation of said platform, and
    generate resistance when oblique muscles rotate the feet, hips, and legs of an individual standing on said platform;

(b) having the individual stand on said platform with each foot on an opposite side of and contacting said divider;

(c) having the individual grasp said first handle with the individual's right hand;

(d) having the individual grasp said second handle with the individual's left hand;

(e) having the individual, while grasping said handles, maintain his arms in fixed position;

(f) having the individual slightly bend his knees from the position where the individual's knees would be locked and straight;

(g) having the individual
  (i) turn his legs, knees, and hips to the left by simultaneously pressing his right foot against said divider and rotating his hips and said platform to the left, and
  (ii) maintain the individual's knees in the slightly bent position;

(h) having the individual
  (i) turn his legs, knees, and hips to the right by simultaneously pressing his left foot against said divider and rotating his hips and said platform to the right, and,
  (ii) maintain the individual's knees in the resulting slightly bent position; and, (i) repeating steps (g) and (h) at a desired number of repetitions per minute for a selected period of time.

* * * * *